US010598010B2

(12) United States Patent
Erdmann et al.

(10) Patent No.: US 10,598,010 B2
(45) Date of Patent: Mar. 24, 2020

(54) METHOD FOR CONSTRUCTING A CONTINUOUS PVT PHASE ENVELOPE LOG

(71) Applicants: Svenja Erdmann, Hannover (DE); Stefan Wessling, Hannover (DE); Nicklas J. Ritzmann, Celle (DE); Oliver Mohnke, Celle (DE); Holger F. Thern, Hannover (DE)

(72) Inventors: Svenja Erdmann, Hannover (DE); Stefan Wessling, Hannover (DE); Nicklas J. Ritzmann, Celle (DE); Oliver Mohnke, Celle (DE); Holger F. Thern, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 255 days.

(21) Appl. No.: 15/238,424

(22) Filed: Aug. 16, 2016

(65) Prior Publication Data

US 2018/0051558 A1 Feb. 22, 2018

(51) Int. Cl.
*E21B 49/00* (2006.01)
*E21B 49/08* (2006.01)

(52) U.S. Cl.
CPC ..... *E21B 49/005* (2013.01); *E21B 49/081* (2013.01); *E21B 49/086* (2013.01)

(58) Field of Classification Search
CPC ..... E21B 49/005; E21B 49/086; E21B 49/081
See application file for complete search history.

(56) References Cited

U.S. PATENT DOCUMENTS 8,109,334 B2 2/2012 Goodwin
2006/0155472 A1* 7/2006 Venkataramanan .... E21B 49/00 702/10

(Continued)

FOREIGN PATENT DOCUMENTS

WO 2015138807 A1 9/2015

OTHER PUBLICATIONS

Hayworth, J. H. et al., "Interpretation of Hydrocarbon Shows Using Light (C1-C5) Hydrocarbon Gases from Mud-Log Data," (C1-C5) Hydrocarbon Gases from Mud-Log Data, AAPG Bulletin, 69(8), 1305-1310.

(Continued)

*Primary Examiner* — Mohamed Charioui
*Assistant Examiner* — Jeremy A Delozier
(74) *Attorney, Agent, or Firm* — Mossman, Kumar & Tyler, PC

(57) ABSTRACT

A method for generating a phase envelope log to characterize a subsurface formation includes drilling the borehole with a drill string, circulating a drilling fluid in the borehole, drawing a fluid sample representing a fluid contained in the subsurface formation, estimating a PVT parameter indicative of an in-situ condition of the subsurface formation from the drawn fluid sample, determining at least two phase envelopes at different depths using the estimated PVT parameter, and creating a phase envelope log formed of a continuous series of phase envelopes using the phase envelopes. A related system includes a drill string, a fluid sampling system, and a processor that estimates a PVT parameter indicative of an in-situ condition of the subsurface formation, determines at least two phase envelopes at different depths using the PVT parameter, and creates the phase envelope log.

18 Claims, 3 Drawing Sheets

(56) References Cited

U.S. PATENT DOCUMENTS

| | | | | |
|---|---|---|---|---|
| 2007/0119244 | A1* | 5/2007 | Goodwin | E21B 47/10 73/152.28 |
| 2011/0307186 | A1 | 12/2011 | Mostowfi et al. | |
| 2013/0197808 | A1 | 8/2013 | Zuo et al. | |
| 2014/0238670 | A1* | 8/2014 | Pop | E21B 7/04 166/264 |

OTHER PUBLICATIONS

Otavie, Imo-Jack, SPE 167560, An Analytical Approach to Consistency Checks of Experimental PVT Data, SPDC and Chima Emelle, SPDC.

Bixler, B.O., Formation Evaluation by Analysis of Hydrocarbon Ratios. J Pet Technol 21 (6): 665-670, (1969).

PCT/US2017/047142 International Search Report dated Nov. 6, 2017.

* cited by examiner

METHOD FOR CONSTRUCTING A CONTINUOUS PVT PHASE ENVELOPE LOG

BACKGROUND

1. Field of Disclosure

In aspects, the present disclosure relates to characterizing underground formations and/or features. In further aspects, the present disclosure relates to methods and devices for generating PVT phase envelope logs for a subterranean formation.

2. Description of the Related Art

Wells, tunnels, and other similar holes formed in the earth may be used to access geothermal sources, water, hydrocarbons, minerals, etc. and may also be used to provide conduits or passages for equipment such as pipelines. Such a hole is commonly referred to as a borehole or wellbore of a well and any point within the borehole is generally referred to as being downhole. Boreholes are commonly used in significant capital commercial developments, such as hydrocarbon fields. Therefore, before field development begins, operators desire to have as much information as possible in order to evaluate the reservoir for commercial viability. Such information may be acquired at the seismic exploration phase, during well construction, prior to well completion and/or any time thereafter.

A vast amount of the information used for characterizing reservoirs is based directly or indirectly on measurements made in a borehole traversing a hydrocarbon reservoir of interest. Of particular value is knowledge of PVT properties of the reservoir fluid. PVT is an acronym used to refer to pressure, volume and temperature. PVT phase envelopes are used to characterize a fluid. Such phase envelopes are estimated from chemical composition together with pressure and temperature data. Bubble point, dew point, asphaltene dropout point, critical temperature and other PVT properties can be inferred from the PVT phase envelope. Knowing such information allows for the adjustment of the design of the production and surface equipment to take into account the actual PVT properties.

In aspects, the present disclosure is directed to devices, systems and methods that may be utilized to obtain or improve information that may be used for obtaining a PVT phase envelope and/or PVT properties log.

SUMMARY

In aspects, the present disclosure provides a method for generating a phase envelope log to characterize a subsurface formation intersected by a borehole. The method may include drilling the borehole with a drill string; circulating a drilling fluid in the borehole; drawing at least one fluid sample representing at least a portion of a fluid contained in the subsurface formation; estimating at least one PVT parameter indicative of an in-situ condition of the subsurface formation from the drawn at least one fluid sample; determining at least two phase envelopes at different depths using the estimated at least one PVT parameter; and creating a phase envelope log formed of a continuous series of phase envelopes using the at least two phase envelopes.

In aspects, the present disclosure provides a system for generating a phase envelope log to characterize a subsurface formation intersected by a borehole. The system may include a drill string configured to drill the borehole; a fluid sampling system configured to retrieve at least one fluid sample representative of a fluid in the subsurface formation; and a processor. The processor may be configured to estimate at least one PVT parameter indicative of an in-situ condition of the subsurface formation using the drawn at least one fluid sample; determine at least two phase envelopes at different depths using the estimated at least one PVT parameter; and create a phase envelope log formed of a continuous series of phase envelopes using the at least two phase envelopes.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
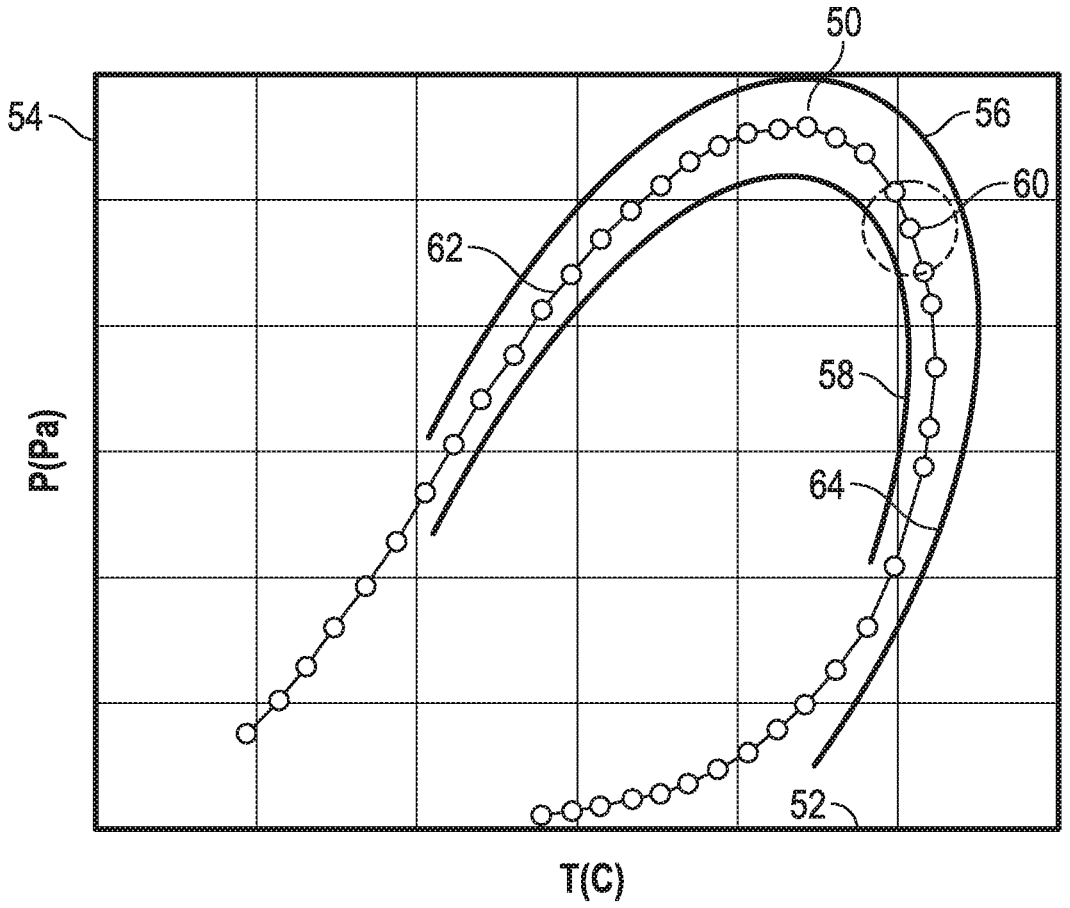
FIG. 1 illustrates a PVT phase envelope and associated PVT properties that may be generated using the methodologies in accordance with the present disclosure.

The present disclosure relates to devices and methods for continuously obtaining a PVT phase envelope log while drilling a borehole. By continuous, it is meant that the disclosed methodology enables the determination of PVT phase envelopes while drilling or at discrete stopping points during drilling and combining those envelopes to derive a representation of PVT properties along the measured depth of a borehole. PVT phase envelopes and properties are shown in the drawings, and herein will be described in detail, specific embodiments of the present disclosure with the understanding that the present disclosure is to be considered an exemplification of the principles described herein, and is not intended to limit the disclosure to that illustrated and described herein. Accordingly, the embodiments discussed below are merely illustrative of the applications of the present disclosure.

Referring to FIG. 1, there is shown an exemplary PVT phase envelope 50 for a formation fluid that may be generated using the present teachings. Temperature is along the "X" axis 52 and pressure is along the "Y" axis 54. An outer curve 56 and an inner curve 58 bound the uncertainty around a PVT phase envelope 60. Generally speaking, the curves 56, 58, represent an uncertainty range of calculated pressure, volume, and temperature values at which a reservoir fluid or subsurface fluid may transition to or from a gas, liquid, or a mixture, which is commonly referred to as a phase transition. For instance, a region 62 along curve 60 may identify a "bubble point" and a region 64 along the curve 60 may identify a "dew point." As used herein, a PVT parameter is one or more of pressure, volume and temperature. A PVT property includes, but is not limited to, bubble point, dew point, asphaltene dropout point, gas-oil ratio, API gravity, viscosity, saturation pressure, formation volume factor, molecular weight, density and oil compressibility. Knowing such information allows for the adjustment of the design of the production and surface equipment to take into account the actual PVT properties.

Multiple phase envelopes may be derived using data acquired at different depths along a borehole trajectory. The comparison of PVT properties and/or the PVT envelopes provides a means to characterize a subsurface formation; hence a combination of multiple PVT phase envelopes into a continuous log along a well trajectory may be used for such characterization. Multiple PVT phase envelopes may thus be arranged with measured depth along the well trajectory and areas without information about the phase envelope may be filled by interpolating between two adjacent phase envelopes. Likewise, phase envelopes may be extrapolated to extend a phase envelope log. Phase envelope logs may also be re-sampled to derive a continuous, equally sampled log of phase envelopes.

Phase envelope logs may then be displayed on a computer to allow a user to characterize a subsurface formation. For example, such logs may be displayed as a tube-like representation around a well trajectory, and other formation evaluation logs may be displayed together with the phase envelope log. For example, a gamma ray log, a neutron-density log, a magnetic resonance log, an acoustic log, a resistivity log, or a combination thereof may be used in addition to the phase envelope log to characterize a subsurface formation. Alternatively or in addition, phase envelope logs or PVT properties may be displayed as depth-based logs, here referred to as compositor logs.

Subsurface characteristics inferred from such a representation of PVT properties within a subsurface may include a fluid contact between two different reservoir fluids. For example, a hydrocarbon reservoir bearing a gas cap and oil below the gas cap may be represented as an abrupt change in the PVT phase envelope log at the fluid contact between the gas and the oil, because the gas and oil exhibit different fluid chemical compositions. Alternatively, a gradual change in the shape of the PVT phase envelope log may be observed indicating that the fluid chemical composition of a subsurface fluid is gradually changing.

In another embodiment, phase envelope logs may be used to identify fluid compartments, which may be conducted in all types of wells such as exploration and appraisal wells or production and injection wells. Fluid compartments are here referred to as zones within a reservoir which are hydraulically disconnected between each other, either through a structural hydraulic barrier (such as an impermeable fault) or through a stratigraphic barrier (such as a low-permeability cross-bed). Efficient reservoir drainage requires a good understanding of such compartments, so that a phase envelope log to identify fluid compartments may be of particular relevance for horizontal production/injection wells during the field development phase.

Figure 2:
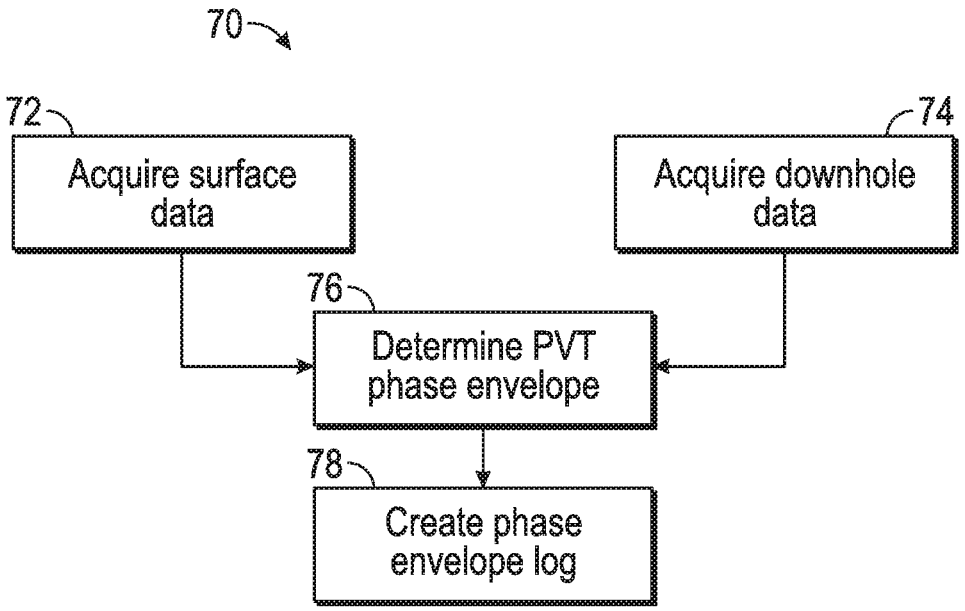
FIG. 2 is a block diagram of a method according to the present disclosure.

Referring to FIG. 2, there is shown a flow chart illustrating a method 70 to generate a PVT phase envelope log in accordance one non-limiting embodiment of the present disclosure. Generally, the method 70 involves acquiring the chemical composition of hydrocarbons and other elements within fluid which originates from a subsurface formation. In one embodiment, surface mud logging equipment, block 72, may be used in combination with acquiring pressure and temperature information from a downhole instrument, block 74. The acquired information is specific to a particular borehole depth. Using known algorithms and modeling, this acquired information is processed to obtain a PVT phase envelope, block 76. At block 78, a phase envelope log, which is formed of a continuous series of phase envelopes, is created by using at least two phase envelopes. Advantageously, the method 70 may provide PVT related information in "real time" or continuously while drilling is ongoing as opposed to hours or even days later as with conventional PVT determination techniques.

Figure 3:
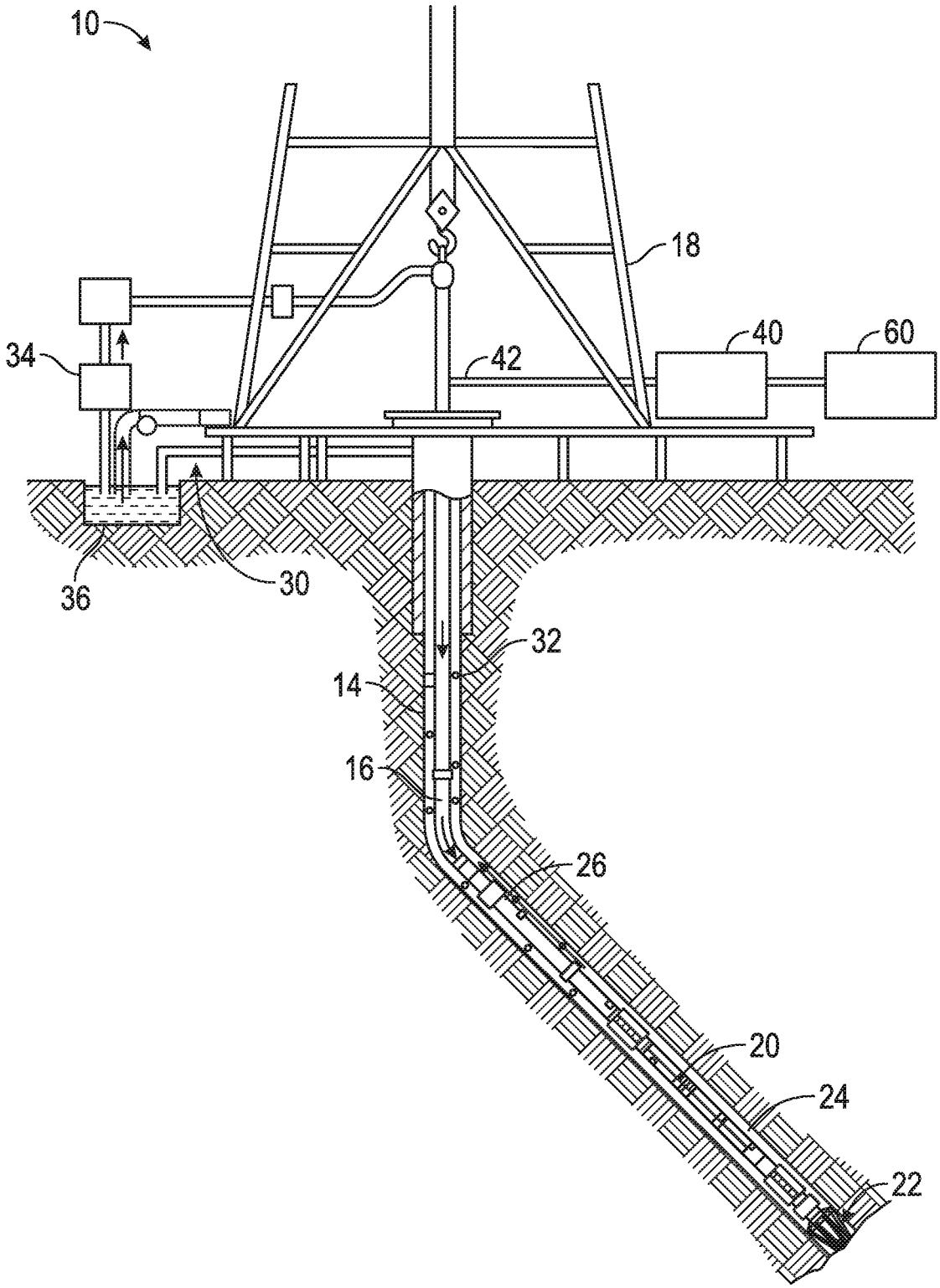
FIG. 3 illustrates a drilling system that may be used in conjunction with the methods according to the present disclosure.

Referring to FIG. 3, there is schematically represented a system 10 for drilling a borehole 12. The borehole 12 may be used to access geothermal sources, water, hydrocarbons, minerals, etc. and may also be used to provide conduits or passages for equipment such as pipelines. The system 10 shown in FIG. 3 has a bottomhole assembly (BHA) 20 conveyed in a borehole 12 via a drill string 16. The drill string 16, which include drill pipe or coiled tubing, extending downward from a rig 18 into the borehole 12. The drill string 16 may be rotated by a top drive (not shown) or other suitable rotary power device. The BHA 20 may include a drill bit 22. The BHA 20 may also include other devices (not shown) such a steering unit, a drilling motor, a sensor sub, a bidirectional communication and power module (BCPM), and a formation evaluation (FE) sub.

Conventionally, one or more mud pumps 34 at the surface draw the drilling fluid, or "drilling mud," from a mud pit 36 and pump the drilling mud via the drill string 16 into the borehole 12. The drilling mud exits at the drill bit 22 and flows up the annulus 24 to the surface as a return fluid 26. In some situations, a reverse circulation scheme may be used. In reverse circulation, the fluid is conveyed into the annulus 24 at the surface. This fluid flows downhole and enters the drill string 16 at the well bottom and returns to the surface via a bore (not shown) of the drill string 16. Thus, the returning drilling fluid 26 may flow along the annulus 24 or through the bore of the drill string 16. The returning drilling fluid 26 may include entrained fluids from the formation traversed by the borehole 12. The entrained fluids may include native formation fluids such as hydrocarbons and non-hydrocarbons. These formation fluids may have been liberated from by the action of the drill bit 22 or a formation sampling tool (not shown) associated with the BHA 20.

In one non-limiting embodiment, a surface logging system 40 may be used to acquire real-time or near real-time information for developing PVT phase envelopes. The surface logging system 40 may include a fluid sampling line 42 that is in direct fluid communication with the return fluid and one or more instruments configured to analyze one or more components of the return fluid 26. Illustrative instruments include mass spectrometers, gas chromatographs, spectroscopic devices and other sensors configured to provide chemical, compositional, and physical information regarding the components of the return fluid 24. The surface logging system 40 may include an information processor, a data storage medium, display devices, and suitable circuitry for storing and implementing computer programs and instructions. The data storage medium may be any standard computer data storage device, such as a USB drive, memory stick, hard disk, removable RAM, or other commonly used memory storage system known to one of ordinary skill in the art including Internet based storage. The data storage medium may store a program and data collected during the testing process.

Figure 4:
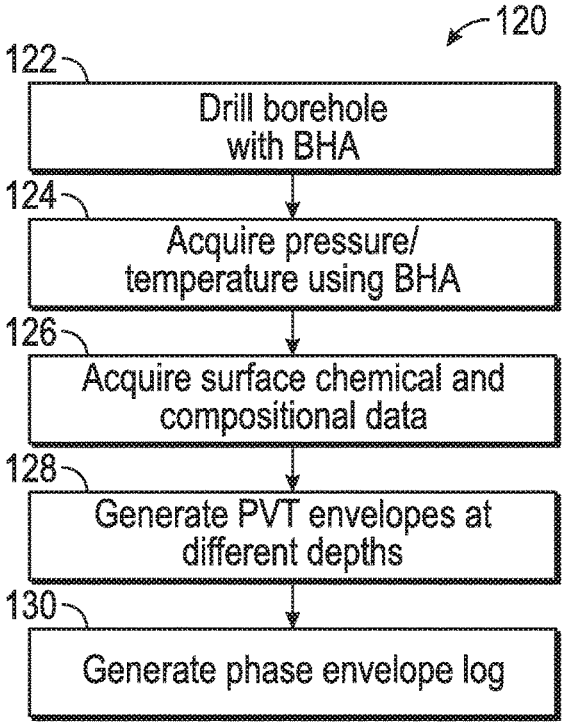
FIG. 4 illustrates one method according to the present disclosure.

Referring to FIGS. 3 and 4, in one implementation, a method 120 may include drilling the borehole 12 with the BHA 20 at step 122. Concurrently, at step 124, sensors in the BHA 20 can acquire formation pressure and temperature for the drilled formation. This information can be transmitted to the surface using suitable communication uplinks via mud pulse telemetry, wired pipe, or other suitable telemetry arrangements.

At step 126, the return fluid 24 is analyzed by the surface mud gas logging system 40 to determine chemical and compositional data of the formation fluid (hydrocarbons and non-hydrocarbons) in the return fluid. During the drilling and throughout the fluid sampling activity, the surface gas analysis system 30 generates a continuous log of one or more gas properties. The circulating drilling fluid transports the liberated fluid 34 to the surface and a sample is drawn using the fluid sampling line 32. The drawn fluid is a mix of surface introduced drilling fluid (or mud) and native formation fluid. Hydrocarbons and/or non-hydrocarbons from the formation 10 evaporate into gaseous phase at the surface under atmospheric conditions. Depending on the mud, its temperature and hydrocarbon combination, the amount of hydrocarbons in solution may vary and single components may have a different solubility. In one non-limiting arrangement, hydrocarbon extraction is accomplished by feeding the drilling fluid through a vessel with a mechanical agitator and using a vacuum pressure to suck the evaporated hydrocarbons from a headspace of a trap towards the gas logging system 30. Other arrangements such as a membrane system may be used.

The formation fluid can enter the return fluid in several ways. One way is at the time the drill bit 26 crushes the rock and earth at the well bottom. In this case, the formation fluid is liberated during the normal drilling activity. Another way is by actively liberating the formation fluid from a depth uphole of the well bottom. For instance, a formation sample tool may retrieve a fluid sample from a selected formation and inject that retrieved fluid sample into the return fluid. In either case, the delay in the return fluid 26 in flowing to the surface, or "lag time," will have to be corrected for matching the pressure and temperature information with the chemical and compositional data for the drilled formation.

At step 128, the pressure and temperature acquired downhole and the surface determined chemical composition may be inputted into an information processor 60, which may be located at the rig 18 or at a remote location. The information processor 60 may be provided with a data storage medium, display devices, and suitable circuitry for storing and implementing computer programs and instructions. The information processor 60 may also include computer models and algorithms for estimating the properties and/or behavior of the return fluid. In one non-limiting embodiment, the information process 60 may use an equation of state (EOS) model that represents the phase behavior of the petroleum fluid in the reservoir. The EOS model may be used to obtain saturation pressure at a given temperature as well as Gas-oil-ratio (GOR), Condensate-gas-ratio (CGR), phase densities, and volumetric factors.

The information processor 60 uses the inputted information and the algorithms/models to generate a PVT phase envelope log for the formation being drilled. It should be appreciated that a PVT phase envelope log may be continuously generated as the BHA 20 traverses successive layers or section of a subsurface. Thus, PVT information is available while drilling and may be used to optimize or otherwise adjust drilling parameters, drilling direction, etc. In addition, a PVT phase envelope may be used to optimize or design a completion string. For example, inflow-control devices may be positioned along a production well to control the production of hydrocarbons from different fluid compartments.

The generated PVT phase envelope log may be compared with in situ downhole measurements like bubble point, chemical composition and/or others to validate phase envelopes for specific downhole fluid sampling and testing depths. The generated PVT logs may also be used to quality control and optimize sampling operations, like the maximum possible drawdown pressure before crossing the bubble point and/or dew point line.

Figure 5:
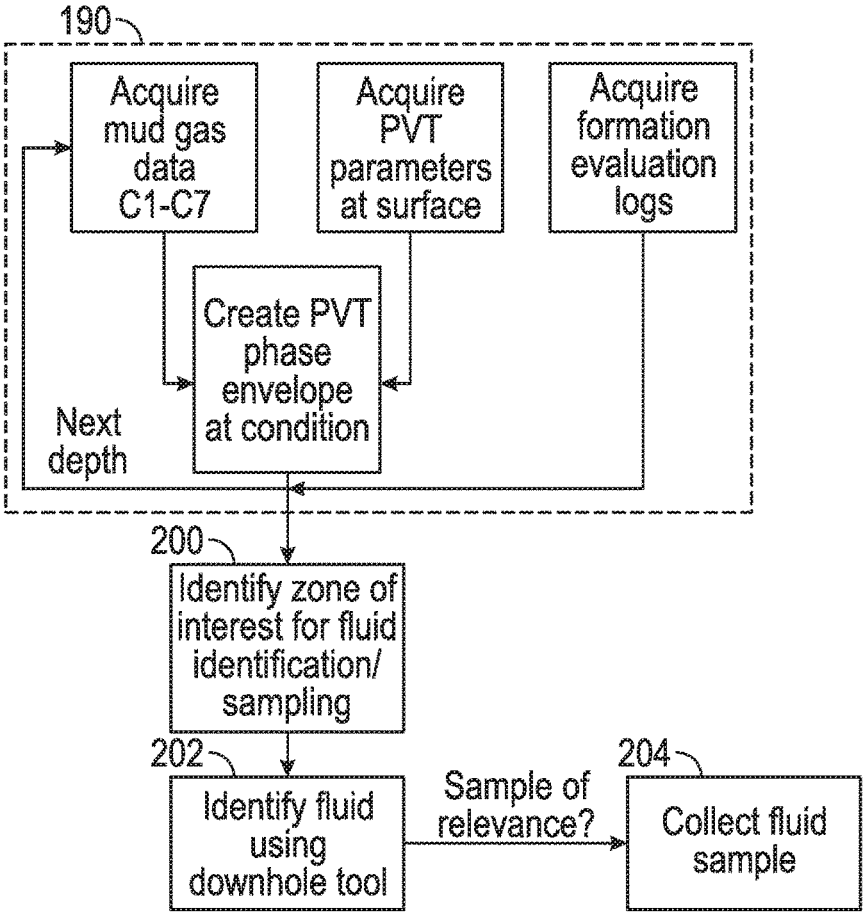
FIG. 5 is a block diagram of another method according to the present disclosure.

FIG. 5 provides an example workflow for a fluid sampling advisor wherein box 190 generally illustrates the process to create a continuous PVT phase envelope log obtained from the fluid chemical composition from mud gas data at the surface of a drill rig. Due to the necessity of transferring the chemical composition acquired at the surface to downhole in situ conditions, the phase envelope log acquired at from mud gas data may lack in accuracy. The accuracy of the results from the process of box 190 may thus be improved by using downhole fluid sampling or fluid identification tools to determine the fluid chemical composition under in situ conditions. The selection of the sampling or fluid identification point for the tool may be guided by the PVT phase envelope log and/or a combination of formation evaluation logs. For example, at step 200, promising hydrocarbon-bearing formations may be identified. After the fluid has been sufficiently identified to evaluate the benefits of a sample at step 202, a fluid sample is drawn from that formation at step 204.

The downhole fluid sampling operation may then be configured in a way to deliver PVT properties such as the bubble point or the dew point for in situ conditions. For example, a pressure drawdown may be conducted at a given formation temperature and the fluid parameters such as fluid density, viscosity, refractive index, acoustic wave propagation velocity or similar may be monitored to identify a phase transition. The detection of such a phase transition may then be used to calibrate or validate the continuous PVT phase envelope log by comparing dew or bubble points (validation) or by adjusting the PVT phase envelope log (calibration).

In another embodiment, a PVT phase envelope log derived from mud gas data at the surface may indicate circumstances which are disadvantageous for the conduction of a downhole fluid sampling operation by a downhole tool. For example, the phase envelope log may, at a particular depth, indicate the formation reservoir pressure being close to the bubble point, so that an excessive drawdown would precipitate asphaltenes from the liquid phase into the solid phase. Such asphaltenes may plug flow lines within the sampling device, which should be avoided to ensure a successful sampling operation. A PVT phase envelope log may thus be used to define a maximum drawdown possible to keep the subsurface fluid in a single phase.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. A method for generating a phase envelope log to characterize a subsurface formation intersected by a borehole, the method comprising:

drilling the borehole with a drill string;

circulating a drilling fluid in the borehole, the drilling fluid being circulated from the surface into the borehole;

drawing at least one fluid sample representing at least a portion of a fluid contained in the subsurface formation, wherein the at least one fluid sample is drawn from the drilling fluid at the surface while the borehole is being drilled by the drill string;

estimating at least one PVT parameter indicative of an in-situ condition of the subsurface formation from the drawn at least one fluid sample;

determining at least two phase envelopes at different depths using the estimated at least one PVT parameter; and creating a phase envelope log formed of a continuous series of phase envelopes using the at least two phase envelopes.

2. The method of claim 1, wherein the creating is done by one of: (i) sorting the at least two phase envelopes according to depth, (ii) interpolating the at least two phase envelopes according to depth, and (iii) extrapolating the at least two phase envelopes according to depth.

3. The method of claim 1, wherein the phase envelope log is displayed along at least one of: (a) borehole trajectory, and (ii) in a composite log.

4. The method of claim 1, wherein the drawing is conducted at a drill rig using surface logging equipment.

5. The method of claim 1, wherein the at least one PVT parameter is at least one of: (i) pressure, (ii) temperature.

6. The method of claim 1, wherein the at least two phase envelopes are derived from a chemical composition of the at least one fluid sample.

7. The method of claim 6, wherein the chemical composition is derived from at least one of a gas chromatograph, a mass spectrometer, and a spectroscopic analyzer.

8. The method of claim 1, further comprising controlling a downhole device using at least a portion of the PVT phase envelope log.

9. A system for generating a phase envelope log to characterize a subsurface formation intersected by a borehole, the system comprising:

a drill string configured to drill the borehole;

a fluid sampling system configured to retrieve at least one fluid sample representative of a fluid in the subsurface formation at a surface location; and a processor configured to:

estimate at least one PVT parameter indicative of an in-situ condition of the subsurface formation using the drawn at least one fluid sample;

determine at least two phase envelopes at different depths using the estimated at least one PVT parameter; and create a phase envelope log formed of a continuous series of phase envelopes using the at least two phase envelopes.

10. The system of claim 9, wherein the fluid sampling system is configured to retrieve the fluid sample at a downhole location.

11. The system of claim 9, further comprising a chemical composition analyzer selected from at least one of: a gas chromatograph, a mass spectrometer, and a spectroscopic analyzer, the chemical composition analyzer estimating a chemical composition of the drawn at least one fluid sample.

12. A method for generating a phase envelope log to characterize a subsurface formation intersected by a borehole, the method comprising:

drilling the borehole with a drill string;

circulating a drilling fluid from the surface in the borehole;

drawing at least one fluid sample representing at least a portion of a fluid contained in the subsurface formation while drilling the borehole with the drill string and while circulating the drilling fluid from the surface into the borehole;

estimating at least one PVT parameter indicative of an in-situ condition of the subsurface formation from the drawn at least one fluid sample;

determining at least two phase envelopes at different depths using the estimated at least one PVT parameter; and creating a phase envelope log formed of a continuous series of phase envelopes using the at least two phase envelopes, the creating being done by one of: (i) sorting the at least two phase envelopes according to depth, (ii) interpolating the at least two phase envelopes according to depth, and (iii) extrapolating the at least two phase envelopes according to depth.

13. The method of claim 12, further comprising estimating a PVT property from the phase envelope log, the PVT property comprising at least one of (i) bubble point, (ii) dew point, and (iii) asphaltene dropout point.

14. The method of claim 13, further comprising displaying the PVT property along at least one of: (i) a borehole trajectory, and (ii) a composite log.

15. The method of claim 13, wherein the at least one PVT property is used to at least one of: (i) calibrate at least a portion of the phase envelope log, and (ii) validate at least a portion of the phase envelope log.

16. The method of claim 13, further comprising measuring at least one PVT property with a downhole device under in situ conditions.

17. The method of claim 13, further comprising determining a characteristic of the subsurface formation using the phase log envelope, the characteristic being at least one of: a fluid contact, a fluid compartment, a zone with fluid compositional grading, and a geological barrier.

18. The method of claim 17, wherein the characteristic is used to define a subsurface formation to draw a fluid sample using a downhole fluid sampling device.

* * * * *